US006866572B1

(12) United States Patent
Wendt-Ginsberg et al.

(10) Patent No.: US 6,866,572 B1
(45) Date of Patent: Mar. 15, 2005

(54) PLATED GRINDING TOOL

(75) Inventors: Marion Wendt-Ginsberg, Windeck (DE); Frank Wendt, Windeck (DE)

(73) Assignee: M&F Entwicklungs, Windeck (DE)

( * ) Notice: Subject to any disclaimer, the term of this patent is extended or adjusted under 35 U.S.C. 154(b) by 0 days.

(21) Appl. No.: 09/646,745

(22) PCT Filed: Mar. 22, 1998

(86) PCT No.: PCT/EP99/01934

§ 371 (c)(1),
(2), (4) Date: Nov. 10, 2000

(87) PCT Pub. No.: WO99/48647

PCT Pub. Date: Sep. 30, 1999

(30) Foreign Application Priority Data

Mar. 21, 1998 (DE) ..... 198 12 515

(51) Int. Cl.[7] ..... B23F 21/03
(52) U.S. Cl. ..... 451/465; 451/541
(58) Field of Search ..... 451/541, 463, 451/465, 466, 379, 378, 342

(56) References Cited

U.S. PATENT DOCUMENTS

| | | | | |
|---|---|---|---|---|
| 3,191,208 A | | 6/1965 | Churchill | |
| 3,406,488 A | | 10/1968 | Rykken | |
| 4,090,333 A | | 5/1978 | Block | |
| 4,302,911 A | * | 12/1981 | Leistner | 51/334 |
| 4,679,360 A | * | 7/1987 | Eisenblatter | 51/337 |
| 5,637,033 A | * | 6/1997 | Williams | 451/342 |
| 5,722,881 A | * | 3/1998 | Emerson | 451/466 |
| 5,871,399 A | * | 2/1999 | Emerson | 451/466 |

FOREIGN PATENT DOCUMENTS

| | | |
|---|---|---|
| DE | 1 986 971 | 6/1968 |
| DE | 25 01 589 | 7/1975 |
| DE | 85 23 363 | 11/1985 |
| DE | 89 03 423 | 6/1989 |
| DE | 40 07 928 | 9/1991 |
| DE | 195 11 004 | 9/1996 |
| EP | 0 446 626 | 9/1991 |
| GB | 938223 | 10/1963 |
| JP | 60094271 | 5/1985 |

OTHER PUBLICATIONS

European Patent Office "International Search Report from International Application Published Under The Patent Cooperation Treaty", International Application No. PCT/EP99/1934 and attached English translation.

European Patent Office, "International Preliminary Examination Report from International Application Published Under Patent Cooperation Treaty", International Application No. PCT/EP99/01934 (corrected copy), and attached English translation.

1993/1994 Tool Catalog of Hch. Perschmann, GmbH, Braunschweig.

* cited by examiner

*Primary Examiner*—Dung Van Nguyen
(74) *Attorney, Agent, or Firm*—Paul A. & Associates, P.C.

(57) ABSTRACT

The invention relates to a plated grinding tool which is symmetrically configured around an axis of rotation. Said plated grinding tool comprises a plurality of grinding plates arranged on the periphery and/or on the faces, and comprises a support body on which said grinding plates are fixed. The plated grinding tool also comprises a device for connecting the plated grinding tool to a drive device. The support body has at least one rotationally symmetric lateral surface on which the grinding plates are at least partially fixed. According to the invention, the support body comprises at least one central element which is configured as a disc and which extends in an essentially radial manner in relation to the axis of rotation. In addition, the device for connecting the plated grinding tool to a drive device has a locating face, said face being formed by the disc, which is provided for connecting the plated grinding tool to a drive device. The support body additionally comprises a carrier ring, a rapid clamping device for connecting the plated grinding tool to a drive device, and a set made up of a plated grinding tool and a rapid clamping device.

13 Claims, 4 Drawing Sheets

PLATED GRINDING TOOL

FIELD OF THE INVENTION

The invention relates to a flap-type grinding tool, which is configured symmetrically about an axis of rotation, having a plurality of abrasive flaps disposed on the periphery and/or end faces, a support body, on which the abrasive flaps are fixed, and a device for connecting the flap-type grinding tool to a drive apparatus, the support body having at least one rotationally symmetrical lateral surface, on which the abrasive flaps are at least partly fixed and a rapid clamping apparatus for connecting a flap-type grinding tool to a drive apparatus and a set comprising a flap-type grinding tool and a rapid clamping apparatus.

Such flap-type grinding tools are preferably used for the treatment of surfaces, especially in the manufacture of molds or car bodies. Special advantages are the resilient adaptation of the abrasive flaps to the contour of the workpiece and the cool grinding. The arrangement of the flaps also results in these tools having a very long service life.

BACKGROUND OF THE INVENTION

Abrasive belts with a flap-shaped configuration are known per se, for example from U.S. Pat. No. 938,223 A1. DE 85 23 363 U1 has disclosed that such an abrasive belt can be tensioned on a hollow cylinder having the dimensions of a steel belt coil to eliminate pressure marks formed when steel belt is wound up onto contact pressure rolls of the winding-on machine before such marks can result in impairments of the surface quality of the steel belt.

Flap-type grinding tools are known in the prior art for the treatment of especially shaped workpiece surfaces, without damaging the surface by striation and the like. Particularly in toolmaking and mold manufacture, such flap-type grinding tools with a radial set of abrasive flaps for fine grinding and polishing work on larger radii have been widely adopted.

Such fan-type grinders for peripheral grinding normally consist of a shaft whereby the grinding tool can be clamped, for example, in a drill chuck, which is shaped and is bonded or pressure-fitted to a rigid core of the fan-type grinder. The flaps are fixed on the core radially, by being bonded in grooves, or tangentially in a layer of adhesive or grouting. Such fan-type grinders are also commercially available, and an embodiment for securing to a shaft by screwing is also described in DE-GM 1 986 971.

Also commercially known is a design of such a fan-type grinder having a radial set of abrasive flaps, in which the core in which the drive shaft is inserted is designed with a recessed end face in order to make it possible for the end faces also of the radially inserted abrasive flaps to be brought in contact with the workpiece. Such a design is also described in the 93/94 tool catalog of Hch. Perschmann GmbH, Braunschweig.

DE 40 07 928 A1 and EP 0 446 626 A1 have disclosed grinding sleeves for peripheral grinding which, to improve economy when such fan-type grinders are used, can be clamped onto a reusable abrasive belt body. In this arrangement, an abrasive belt body of this type comprises the shaft for connection to a drive machine and a rubber body arranged between cones which fixes the grinding sleeve radially by clamping the cones. Such a commercially available abrasive belt body is described, for example, in the 93/94 tool catalog of Hch. Perschmann GmbH, Braunschweig.

For the treatment of weld seams, surface grinding, rust removal and trimming of castings, fan-type grinding wheels are known for use on angle grinding machines in which the set of abrasive flaps is disposed end-on on a disk. Such disks are commercially available, for example, under the name Pferd Polifan and described in the 93/94 tool catalog of Hch. Perschmann GmbH, Braunschweig. These disks consist of a supporting plate of glass-cloth mats which are axially fitted end-on with abrasive flaps and possess at the center a customary receiving hole for fastening to the output spindle of an angle grinder. Glass-cloth mats are used to ensure that the plate with the flaps wears down evenly when the tool is fitted and allows the flaps to be fully consumed.

DE 89 03 423 U1 has disclosed an abrasive flap disk for use with angle grinders in which a number of abrasive flaps are arranged on a disk-shaped carrier on both end faces, first in order to permit the treatment of walls of relatively narrow grooves and secondly in order to obtain an increased service life of the disk as a result of reversibility. To this end, the useful areas, each made of abrasive flaps arranged in a shingle pattern, are oriented in alternating directions relative to each other.

Finally, U.S. Pat. No. 5,722,881 A has disclosed a flap-type grinding tool with a set of abrasive flaps on the radial periphery. In this tool, the abrasive flaps are directly bonded to the radial outside of a disk-shaped support body using an epoxy resin, the disk-shaped support body consisting of an inner metal disk and an outer glass-fiber disk. For fixing on a commercially available angle grinder, the steel disk is provided at the center with a welding nut which projects beyond the lateral surfaces formed by the outsides of the abrasive flaps.

Furthermore, another embodiment is described in which the support body consists of a metal pot which, as well as a central disk-shaped part with a shallow angle, possesses a flanged, radially outward edge onto which, again, the abrasive flaps are bonded by means of epoxy resin. This embodiment is designed to be installed on a projecting shaft end, for example for use on a stationary grinding machine.

All these known flap-type grinding tools have special applications and perform their function. Nevertheless, the use of such tools is associated with relatively high production expense and, because the service life is short in relation to the total material use, a relatively high proportion of waste occurs in use. Because of the high stresses resulting from centrifugal forces and tensile forces on the flaps, efforts have not hitherto been made to reduce the production expense, in order to guarantee operational safety.

The object of the invention is therefore to provide flap-type grinding tools and corresponding accessories with which, with no reduction in operational safety, more economic use with improved production of waste and broader range of applications are possible.

DESCRIPTION OF THE INVENTION

This object is achieved, according to the invention, by a flap-type grinding tool of the type mentioned initially in which the support body comprises at least one central element configured as a disk which extends essentially radially to the axis of rotation and the device for connecting the flap-type grinding tool to a drive apparatus has at least one contact surface formed by the disk for connecting the flap-type grinding tool to a drive apparatus, and the support body additionally comprises a carrier ring on whose radially outermost outside one of the lateral surfaces is formed approximately parallel to the axis of rotation or at least inclined at less than 750 to the axis of rotation.

As a result of the configuration according to the invention, the production of such a tool can be simplified without functional disadvantages and, moreover the quantity of waste caused by consumption can be reduced. In particular, problems with the dimensional stability of such a tool can be avoided; these are caused by the resilience of the flanged edge in the deep-drawing of conventional support bodies and cannot be avoided because of the anisotropy of the semi-finished product caused by rolling the raw material. As a result of the multipart nature of the support body, the abrasive flaps can be particularly simply positioned in a sufficiently exact orientation. After use, the parts of the flap-type grinding tool according to the invention can be separated and disposed of separately or, at least in part, returned to the production cycle.

In a preferred embodiment, the disk is sufficiently angled in the region of the contact surface that the contact surface is disposed axially outside a body of rotation described by the outside edges of the abrasive flaps. As a result, it is possible to use a tool according to the invention even without adapters or intermediate pieces which always require additional set-up times and, in addition, increase the risk of accidents, with particular success on handheld angle grinders, thus broadening their economical range of applications.

In an expedient embodiment, a flap-type grinding tool according to the invention is characterized in that the support body comprises a plastic, preferably a fiber-reinforced plastic, and/or in that the support body is produced from aluminum or steel. In this case, it is advantageous if the disk is produced from a plastic, preferably a fiber-reinforced plastic, or the disk is produced from aluminum or steel.

From the production engineering standpoint, it is favorable here if the carrier ring is produced from a plastic, preferably a fiber-reinforced plastic, or from a hard rubber or hard paper, or the carrier ring is produced from aluminum or steel.

In order to reduce production costs and optimize the damping performance of the flap-type grinding tool, it may be advantageous if carrier ring and disk are produced from different materials.

Particularly with a view to a diversity of embodiments to be adapted to various drives, it may be expedient if carrier ring and disk are connected to one another by press-fitting, bonding or welding. This is also a particularly good way of exploiting the special advantages of various materials. After use, the individual parts can be separated and disposed of or reused separately.

In a particularly advantageous embodiment, the disk is formed by an automatically acting eccentric or centrifugal force clamping apparatus. In this kind of embodiment, the consumable part of a tool according to the invention can be kept particularly small and replaced particularly quickly, especially without the need on each occasion to have to release the chuck or the like, which is a critical safety feature to guard against incorrect operation, and then refasten it again.

For use on stationary machinery and in the treatment of large surfaces, it may be expedient, in order to exploit the advantages according to the invention, if the support body of a flap-type grinding tool according to the invention has a plurality of disks.

Especially for the treatment of molds in mold construction, experiments have shown that it is particularly efficient if a flap-type grinding tool of the type mentioned initially or described above is characterized in that abrasive flaps are disposed both on the periphery and on one end face of the flap-type grinding tool. By comparison with the previously known form in which radially disposed flaps are simply allowed to project axially, the configuration according to the invention allows simultaneous peripheral and end-face grinding with comparable performance features both as regards grinding performance and as regards service life. A further great advantage over the known tool design is that there is virtually no risk of parts of flaps breaking away, because in this case the flaps are stressed only in one direction, in which they are designed to be loaded in this way—specifically, to withstand tensile stress and not bending.

Material use in the consumable article can be further reduced by a flap-type grinding tool of the type mentioned initially in which the support body has a device for connecting the flap-type grinding tool to a rapid clamping apparatus for connecting the flap-type grinding tool to a drive apparatus.

With an embodiment of this type, the set-up times for exchanging a tool of this type can also be substantially reduced, which entails a considerable advantage in terms of an economical use of such tools. In addition, the risk of operational faults and accidents is greatly reduced by the use of such a tool, since correct seating of the tool can be visually verified, by contrast with the previously known fastening by means of chucks or the like based on the application of an adequate clamping force.

In a particularly preferred embodiment, a flap-type grinding tool according to the invention is characterized in that the device for connecting the flap-type grinding tool to a rapid clamping apparatus is adapted to form part of a socket connection or bayonet connection. Such a connection permits particularly secure and rapid connection of the tool to a drive.

It may also be expedient if the device for connecting the flap-type grinding tool to a rapid clamping apparatus comprises a single-pitch or multipitch screw or nut thread, especially if the thread is a coarse-pitched thread, and/or a rectangular or trapezoidal thread.

A flap-type grinding tool of the type described initially or above can be produced in a particularly simple manner if the device for connecting the flap-type grinding tool to a drive apparatus comprises a shaft connected to the support body in a manner fixed in rotation, and the support body consists of a synthetic resin body, in which the abrasive flaps and the shaft are directly embedded. This is particularly advantageous for purposes of disposal after use, as a very much simpler way of separating materials is achieved and hence the cost of disposal is reduced and the components of the tool can be at least partially reused.

The above applies in particular if the support body is produced by at least partial casting of a plastic or synthetic resin into a space formed between the abrasive flaps, positioned relative to one another, and the shaft, and/or the support body consists at least partially of a hard paper (fiber material).

The advantages of a preferred embodiment of the invention can be particularly well utilized with a rapid clamping apparatus for connecting a flap-type grinding tool to a drive apparatus, in which the rapid clamping apparatus is configured to interact with a flap-type grinding tool of the type in question, especially if the disk is a rapid clamping apparatus of this type, and with a set comprising a flap-type grinding tool of this type and a rapid clamping apparatus of this type.

DESCRIPTION OF PREFERRED EXAMPLES OF EMBODIMENT

The invention will be described in more detail below with reference to examples of embodiment shown in the drawings, in which.

in each case in partial section; and

Figure 4:
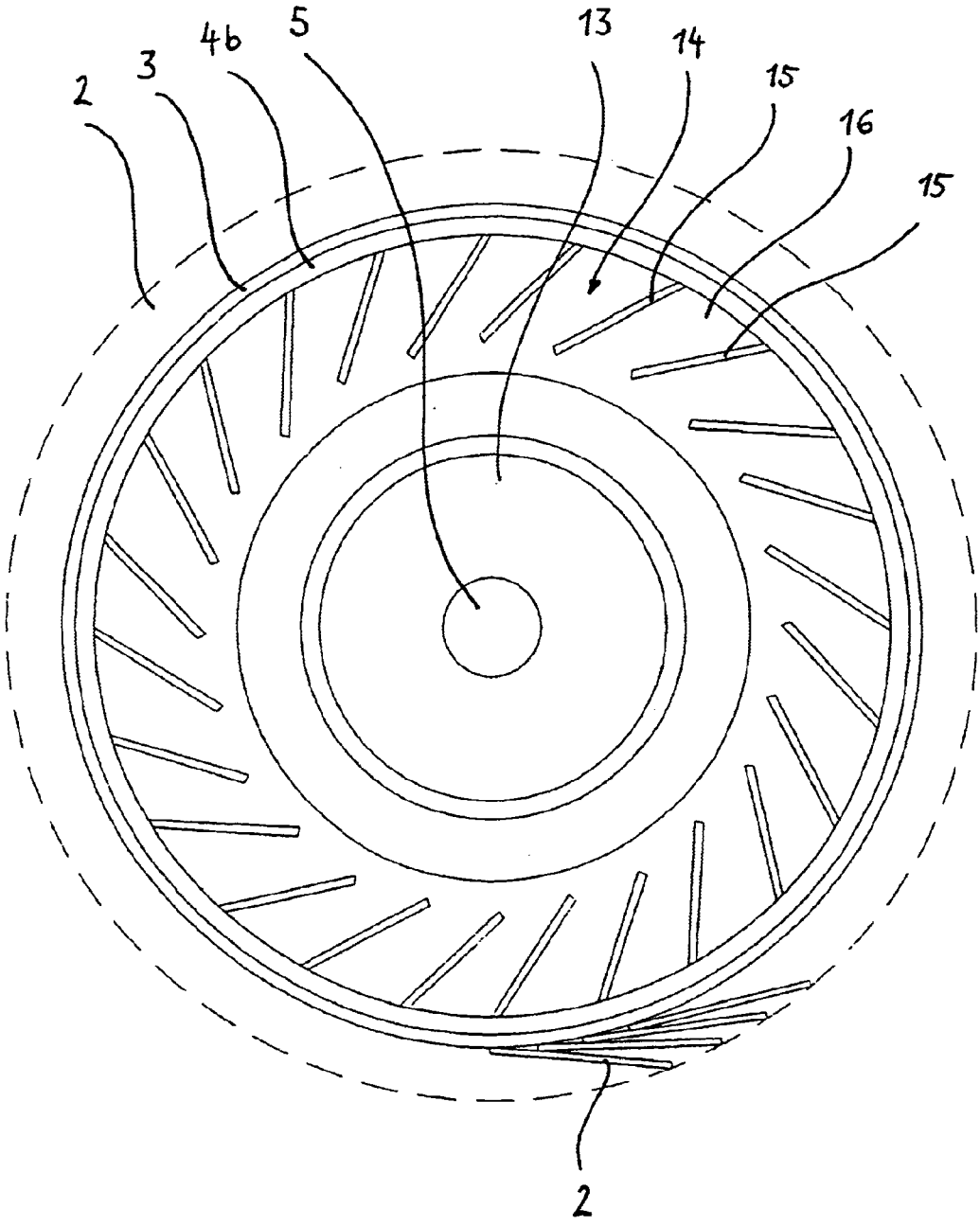

FIG. 4 shows a flap-type grinding tool according to the invention with radially disposed abrasive flaps, in which the disk of the support body is formed by an automatically acting eccentric or centrifugal force clamping apparatus (in partially diagrammatic view).

Figure 1:
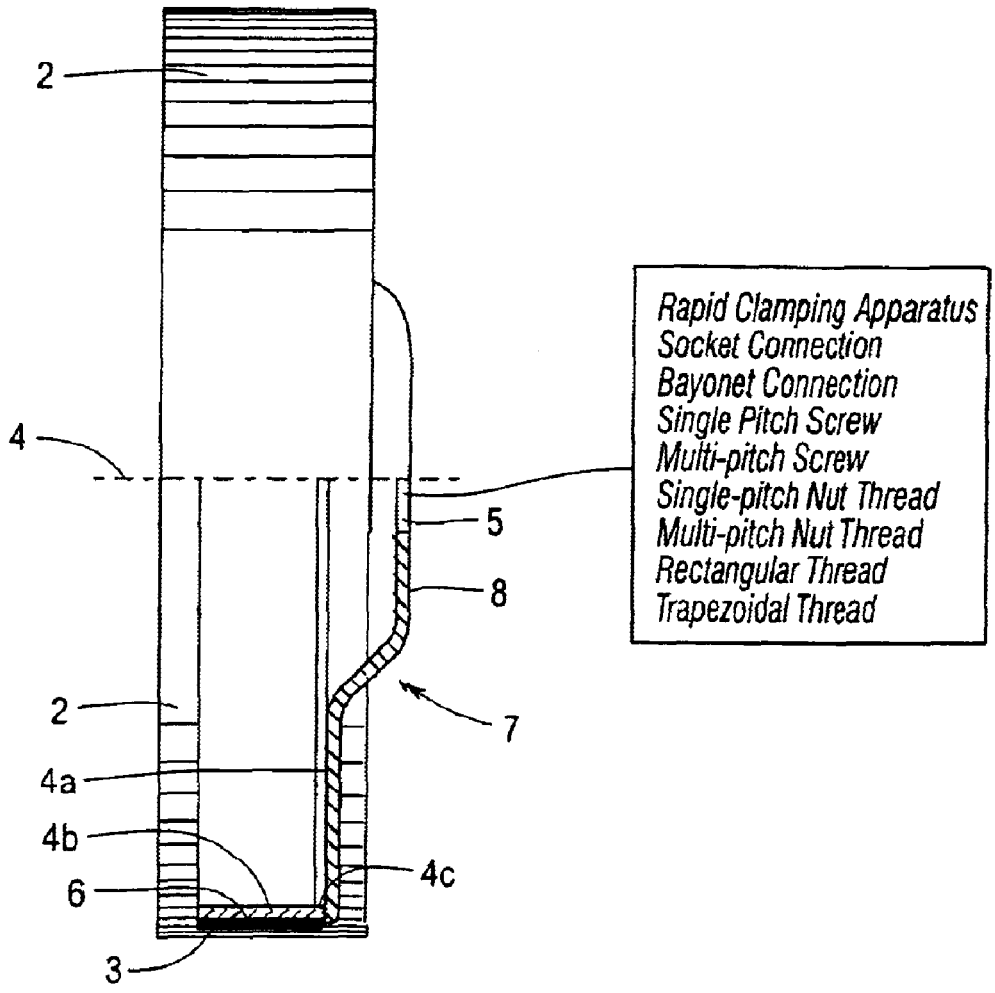
FIG. 1 shows a flap-type grinding tool according to the invention with radially disposed abrasive flaps.

FIG. 1 shows a flap-type grinding tool according to the invention which is symmetrically configured about an axis of rotation 1 and possesses a plurality of abrasive flaps 2 disposed on the periphery. The abrasive flaps 2 are fastened in a conventional manner, for example by means of an adhesive 3, on a support body 4*a*, 4*b*.

The support body here comprises, for example, a deep-drawn metal disk 4*a* which, as a device for connecting the flap-type grinding tool to a drive apparatus, possesses a hole 5 to receive a screw fastening of a conventional drive spindle. A carrier ring 4*b* is fastened in the region of the outer periphery of the metal disk 4*a*. On the outside of the carrier ring 4*b*, a lateral surface 6 is formed, oriented approximately cylindrically to the axis of rotation 1, on which the adhesive 3 for fastening the abrasive flaps 2 is applied, in other words the lateral surface 6 is inclined at approximately 0° to the axis of rotation 1.

As is clearly apparent in FIG. 1, the metal disk 4*a* comprises a central element 7 which extends essentially radially to the axis of rotation 1. A contact surface 8 for contact with a drive apparatus is formed around the central hole 5. For this purpose, the metal disk 4*a* is angled, as a result of which a configuration is also obtained which is particularly strong mechanically. As shown, the disk 4*a* in this case is angled to such an extent that the contact surface 8 is disposed axially outside a body of rotation described by the outer edges of the abrasive flaps 2. As a result, such a tool according to the invention can also be used particularly well for handheld grinders, especially angle grinders, thus broadening its range of applications. In particular, this avoids the possibility of collision between the radially outermost flaps 2 and a conventional protective hood of a commercial angle grinder, where the user might try to remove the protective hood.

In order to obtain clean grinding extending into the corners of the workpiece, it is advantageous if, as shown, at least some of the abrasive flaps 2 project axially, at least on one side, beyond the boundary of the at least one lateral surface 6, especially if the abrasive flaps 2 project at least 3 mm beyond the boundary of the at least one lateral surface 6.

As an alternative to the embodiment shown, in a flap-type grinding tool according to the invention, the support body may comprise a plastic, preferably a fiber-reinforced plastic, and/or the support body may be produced from aluminum or steel. It is advantageous here if the disk 4*a* is produced from a plastic, preferably a fiber-reinforced plastic, or the disk 4*a* is produced from aluminum or steel.

In terms of production engineering, it may be advantageous if the carrier ring 4*b* is produced from a plastic, preferably a fiber-reinforced plastic, a hard rubber or a hard paper, or if the carrier ring 4*b* is produced from aluminum or steel.

In the embodiment shown, disk 4*a* and carrier ring 4*b* are produced from materials that can be welded together, for example steel or aluminum. A weld seam to connect disk 4*a* and carrier ring 4*b* is designated 4*c* and, depending on expedience, can be formed peripherally or only in sections or as spot-welding.

For certain areas of application, in order to reduce production costs and optimize the damping performance of the flap-type grinding tool, it may be advantageous if carrier ring 4*b* and disk 4*a* are produced from different materials. Particularly with a view to a diversity of embodiments to be adapted to various drives, it may be expedient if carrier ring and disk are connected to one another by press-fitting or bonding.

Figure 2:
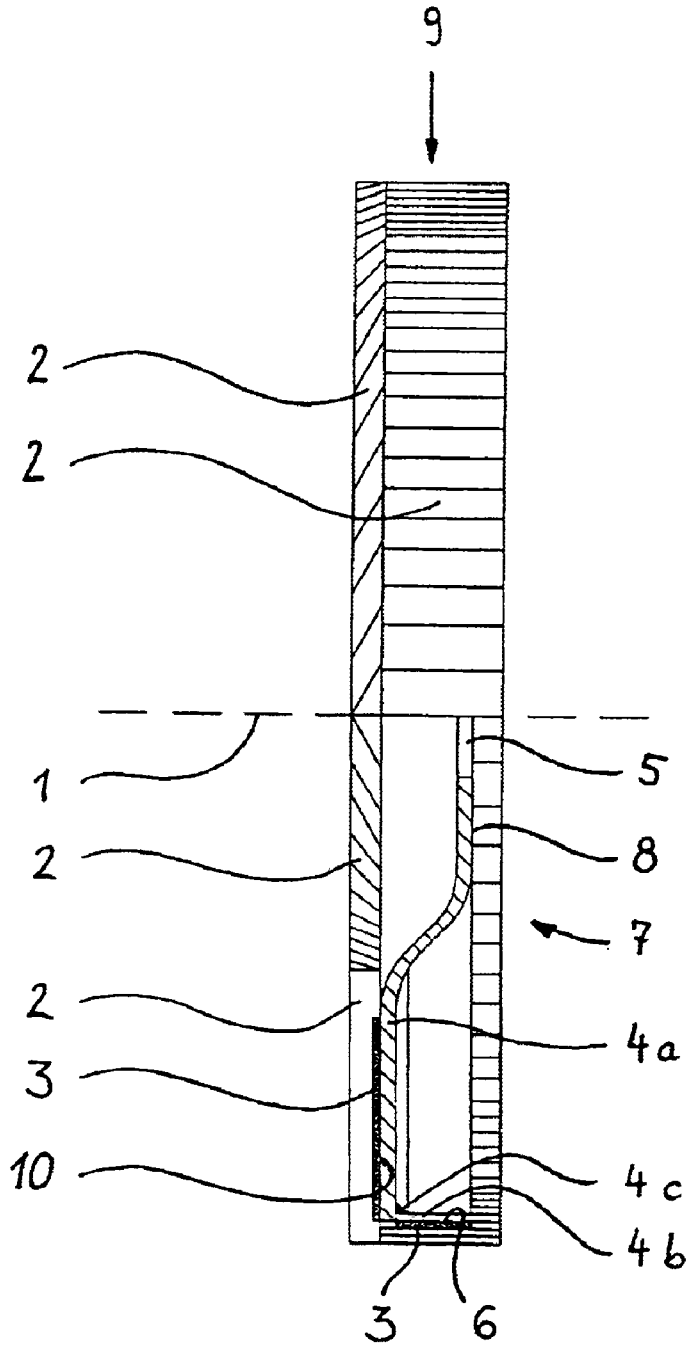
FIG. 2 shows a flap-type grinding tool according to the invention with abrasive flaps disposed radially and on the end face.

Experiments have shown that the flap-type grinding tool shown in FIG. 2 has proven particularly efficient for the treatment, especially, of molds in mold construction. Abrasive flaps 2 are disposed both on the periphery 9 and on one end lateral surface 10 of the flap-type grinding tool. By comparison with the previously known form in which radially disposed flaps 2 are simply allowed to project axially, the configuration according to the invention allows simultaneous peripheral and end-face grinding with comparable performance features both as regards grinding performance and as regards service life. A further great advantage over the known tool design is that there is virtually no risk of parts of flaps breaking away, because in this case the flaps are stressed only in the tensile direction, in which they are designed for appropriate loading.

By comparison with the embodiment shown, it has also proven advantageous to allow the abrasive flaps 2 disposed on the radially outermost periphery to project beyond the abrasive flaps 2 disposed on the end face or axially.

Figure 3:
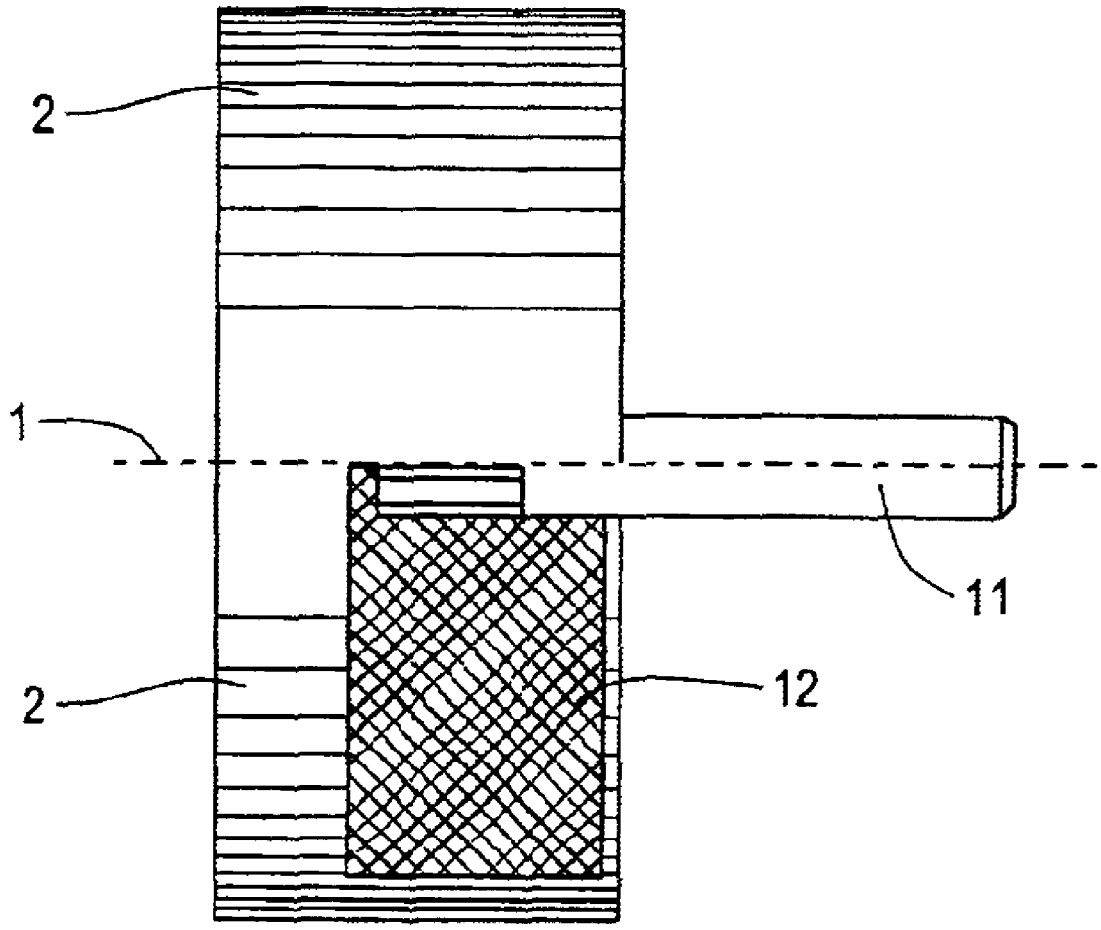
FIG. 3 shows a flap-type grinding tool according to the invention in which a shaft for driving the tool and the abrasive flaps are embedded directly into a synthetic resin body.

The flap-type grinding tool according to the invention shown in FIG. 3 can be produced particularly simply in that a shaft 11 serves as a device for connecting the flap-type grinding tool to a drive apparatus which is connected to the support body in a manner fixed in rotation, and the support body consists of a synthetic resin body 12, in which the abrasive flaps 2 and the shaft 11 are directly embedded. This is particularly advantageous for purposes of disposal after use, as a very much simpler way of separating materials is achieved and hence the cost of disposal is reduced and the components of the tool can be at least partially reused.

As is readily apparent in FIG. 3, the support body here is formed by at least partial casting of a plastic or synthetic resin into a space formed between the abrasive flaps 2, positioned relative to one another, and the shaft 11. The use of hard paper (fiber material) has proven particularly suitable here.

FIG. 4 shows a particularly advantageous embodiment of the invention, diagrammatically and partially simplified. This is particularly suitable for use on a stationary grinding machine in production. The abrasive flaps 2 (of which only a few are drawn in) are in this case, as in the other embodiments, fastened by means of adhesive 3 to a carrier ring 4*b*, for example advantageously consisting of a hard paper. The carrier ring 4*b*, in operation, is disposed radially outwards about a centrifugal force or eccentric clamping apparatus, which replaces the disk 4*a* in the other embodiments described.

This centrifugal force or eccentric clamping apparatus may, for example, comprise a turned aluminum core 13, which may possess a hole 5 to receive a mounting mandrel or may otherwise be expediently configured for coupling to a drive. The aluminum core 13 or a corresponding component made from any other suitable material can in this case be shaped as a hub. In the embodiment shown, a rubber ring 14 is vulcanized on, radially about the core 13. The rubber ring 14 is provided, from its periphery, with numerous slits 15, the slits 15 not extending as far as the radially inner edge of the rubber ring 14 and being disposed at an angle relative to the radius.

If the aluminum core 13 with the rubber ring 14 is caused to rotate, the segments 16 formed between two slits 15 tend, because of the centrifugal forces arising, to stand up radially and so enlarge the outer diameter of the rubber ring 14. If a carrier ring 4*b* has been pushed onto the rubber ring 14, this carrier ring will be automatically tightened by the clamping forces arising.

Thus, during production, the carrier rings 4*b* fitted with abrasive flaps 2 can easily be drawn off and pushed on axially when the machine is at rest, as a result of which minimal set-up times for tool changing are required. This is also particularly safe, as no screw connections of mandrels or chucks have to be released and retightened, which provides no opportunity for something to be forgotten or performed incorrectly.

Depending on the orientation of the abrasive flaps 2, shown only diagrammatically in FIG. 4, to the arrangement of the segments 16, the application of a load moment, for example by grinding work, results, due to the friction between rubber ring 14 and carrier ring 4*b*, in a reinforcement of the clamping and hence an increase in the transmittable torque, for example in order to prevent jamming of the flap-type grinding tool on the workpiece. It may however also be expedient to mount the carrier ring 4*b* in such a way that the abrasive flaps 2 and slits 15 are oriented in the same direction, as a result of which, when the load moment on the periphery of the carrier ring 4*b* is increased by forward slippage of the rubber ring 14, an inward pivoting of the segments 16 and, relative to the carrier ring 4*b*, a reduction of the clamping force arise. This characteristic, similar to a slip clutch, can for example be used for increased protection against accidents in certain applications.

Not shown in the figures is an embodiment of a flap-type grinding tool according to the invention in which the at least one of the lateral surfaces 6 or 10 is disposed approximately parallel to the axis of rotation or inclined at up to and including 90° to the axis of rotation 1 and the support body possesses a device for connecting the flap-type grinding tool to a rapid clamping apparatus for connecting the flap-type grinding tool to a drive apparatus. In this arrangement, the device for connecting the flap-type grinding tool to a rapid clamping apparatus is adapted to form part of a socket or bayonet connection as is conventional, for example, in closure lids. Such a connection permits particularly secure and rapid connection of the tool to a drive, and the proper seating of the tool can readily be determined by eye. Instead of the socket connection, it is also possible to provide a single-pitch or multipitch screw or nut thread, especially in the form of a coarse-pitched thread, the thread advantageously being a rectangular or trapezoidal thread.

Also not shown in the figures is an embodiment, preferably of the stationary operation, in which the flap-type grinding tool possesses a great length in the axial direction to form an extensive grinding width. It is expedient here if the support body possesses two or more disks 4*a*, in order to ensure good supporting of the carrier ring 4*b* on the drive shaft and hence uniform abrasion.

What is claimed is:

1. A flap-type grinding tool which is configured symmetrically about an axis of rotation comprising:

(a) a disk that is an automatically clamping apparatus;

(b) a carrier ring separate from the disk held by the disk; and (c) abrasive flaps attached to the carrier ring.

2. A flap-type grinding tool as recited in claim 1 wherein the disk comprises:

(a) a symmetrical lateral surface;

(b) a central element which extends from the symmetrical lateral surface to an axis of rotation in which the central element produces a contact surface for contact with an external drive apparatus.

3. A flap-type grinding tool as recited in claim 2 wherein the abrasive flaps attached to the carrier ring are attached to a periphery of the carrier ring.

4. A flap-type grinding tool as recited in claim 1 wherein the disk is produced from a material wherein the material is selected from the group consisting of plastic, fiber-reinforced plastic, aluminum, and steel.

5. A flap-type grinding tool as recited in claim 1 wherein the carrier ring is produced from a material wherein the material is selected from the group consisting of plastic, fiber-reinforced plastic, hard rubber, hard paper, aluminum, and steel.

6. A flap-type grinding tool as recited in claim 1 wherein the disk is adapted for connecting to a rapid clamping apparatus for connecting the flap-type grinding tool to an external drive apparatus.

7. A flap-type grinding tool which is configured symmetrically about an axis of rotation comprising:

(a) a disk that is designed as a centrifugal force clamping apparatus for holding the carrier ring;

(b) a carrier ring separate from the disk held by the disk; and (c) abrasive flaps attached to the carrier ring.

8. A flap-type grinding tool which is configured symmetrically about an axis of rotation comprising:

(a) a disk having a core and a rubber ring attached to the core;

(b) a carrier ring separate from the disk held by the disk, the rubber ring is attached to the core in such a manner to enable the rind to expand radially and enlarge an outer diameter of the rubber ring upon rotation of the core which holds the rubber ring, whereby the rubber ring is forced against an inner diameter of a carrier ring holding the carrier ring to the disk; and (c) abrasive flaps attached to the carrier ring.

9. A flap-type grinding tool as recited in claim 8 wherein the rubber ring has a plurality of slits.

10. A flat-type grinding tool which is configured symmetrically about an axis of rotation comprising:

(a) a disk that is designed as an eccentric force clamping apparatus for holding the carrier ring;

(b) a carrier ring separate from the disk held by the disk; and (c) abrasive flaps attached to the carrier ring.

11. A flap-type grinding tool which is configured symmetrically about an axis of rotation comprising:

(a) a disk having a symmetrical lateral surface and a central element which extends from the symmetrical lateral surface to an axis of rotation in which the central element produces a contact surface for contact with an external drive apparatus;

(b) a carrier ring separate from the disk held by the disk;

(c) abrasive flaps attached to the periphery of the carrier ring; and (d) disk abrasive flaps attached to an edge of the symmetrical lateral surface of the disk.

12. A flap-type grinding tool which is configured symmetrically about an axis of rotation comprising:

(a) a disk;

(b) a carrier ring separate from the disk held by the disk the carrier ring has a lateral periphery surface that is inclined from 0 degrees to 75 degrees from the axis of rotration; and (c) abrasive flaps attached to the carrier ring.

13. A flap-type grinding tool which is configured symmetrically about an axis of rotation comprising:

(a) a disk having a symmetrical lateral surface and a central element which extends from the symmetrical lateral surface to an axis of rotation in which the central element produces a contact surface for contact with an external drive apparatus;

(b) a carrier ring separate from the disk held by the disk; and (c) abrasive flaps attached to the periphery of the carrier ring, the disk is sufficiently angled in the region of the contact surface such that the contact surface is disposed axially outside a body of rotation described by the outside edges of the abrasive flaps.

* * * * *

UNITED STATES PATENT AND TRADEMARK OFFICE

CERTIFICATE OF CORRECTION

PATENT NO. : 6,866,572 B1 
APPLICATION NO. : 09/646745
DATED : March 15, 2005
INVENTOR(S) : Marion Wendt-Ginsberg and Frank Wendt It is certified that error appears in the above-identified patent and that said Letters Patent is hereby corrected as shown below:

Cover page, PCT insert --Mar. 22, 1999--

Cover page, Attorney, Agent, or Firm insert --Paul A. Beck & Associates, P.C.--

Figure 1 -- cancel "4" and insert --1--

Column 8, Line 48 cancel "to enable the rind" and insert --to enable the ring--

Column 8, Line 6 cancel "A flat type" and insert --A flap type--

Column 9, Line 13 cancel "by the disk" and insert --by the disk,--

Column 9, Line 6 cancel "rotration; and" and insert --rotation; and--

Signed and Sealed this

Twenty-seventh Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 6,866,572 B1
APPLICATION NO. : 09/646745
DATED : March 15, 2005
INVENTOR(S) : Marion Wendt-Ginsberg and Frank Wendt It is certified that error appears in the above-identified patent and that said Letters Patent is hereby corrected as shown below:

Cover page item [73], Assignee: insert --M&F Entwicklungs-und Patentverwertungs-GmbH--

Signed and Sealed this

Second Day of December, 2008

JON W. DUDAS
*Director of the United States Patent and Trademark Office*